US010612432B2

(12) United States Patent
Heckendorn et al.

(10) Patent No.: US 10,612,432 B2
(45) Date of Patent: Apr. 7, 2020

(54) TRIBOLOGICAL SYSTEM, COMPRISING A VALVE SEAT RING AND A VALVE

(71) Applicant: Mahle International GmbH, Stuttgart (DE)

(72) Inventors: Heiko Heckendorn, Schopfheim (DE); Peter Jaeggi, Bettlach (CH); Roland Ruch, Schopfheim (DE); Roland Scholl, Laufenburg (DE); Klaus Wintrich, Schopfheim (DE)

(73) Assignee: Mahle International GmbH (DE)

( * ) Notice: Subject to any disclaimer, the term of this patent is extended or adjusted under 35 U.S.C. 154(b) by 38 days.

(21) Appl. No.: 15/746,399

(22) PCT Filed: Jun. 30, 2016

(86) PCT No.: PCT/EP2016/065368
§ 371 (c)(1),
(2) Date: Jan. 19, 2018

(87) PCT Pub. No.: WO2017/012841
PCT Pub. Date: Jan. 26, 2017

(65) Prior Publication Data

US 2018/0209311 A1 Jul. 26, 2018

(30) Foreign Application Priority Data

Jul. 21, 2015 (DE) ..... 10 2015 213 706

(51) Int. Cl.

| | |
|---|---|
| ***F01L 3/02*** | (2006.01) |
| ***B22F 5/10*** | (2006.01) |
| ***C22C 33/02*** | (2006.01) |
| ***C22C 38/24*** | (2006.01) |
| ***C22C 38/22*** | (2006.01) |
| ***B22F 5/00*** | (2006.01) |
| ***B22F 3/24*** | (2006.01) |
| ***C22C 19/07*** | (2006.01) |
| ***C22C 22/00*** | (2006.01) |
| ***C22C 38/04*** | (2006.01) |
| ***C22C 38/34*** | (2006.01) |
| ***C22C 38/42*** | (2006.01) |
| ***C22C 38/44*** | (2006.01) |
| ***C22C 38/46*** | (2006.01) |
| ***C22C 38/52*** | (2006.01) |

(52) U.S. Cl.
CPC ..... *F01L 3/02* (2013.01); *B22F 3/24* (2013.01); *B22F 5/008* (2013.01); *B22F 5/106* (2013.01); *C22C 19/07* (2013.01); *C22C 22/00* (2013.01); *C22C 33/0207* (2013.01); *C22C 33/0285* (2013.01); *C22C 33/0292* (2013.01); *C22C 38/04* (2013.01); *C22C 38/22* (2013.01); *C22C 38/24* (2013.01); *C22C 38/34* (2013.01); *C22C 38/42* (2013.01); *C22C 38/44* (2013.01); *C22C 38/46* (2013.01); *C22C 38/52* (2013.01); *B22F 2003/242* (2013.01); *B22F 2003/248* (2013.01)

(58) Field of Classification Search
CPC ..... F01L 3/02; C22C 33/0292; C22C 19/07; C22C 38/46; C22C 38/52; C22C 22/00; C22C 38/04; C22C 38/34; C22C 38/42; C22C 38/44; C22C 38/24; C22C 38/22; C22C 33/0285; C22C 33/0207; B22F 3/24; B22F 5/008; B22F 5/106; B22F 2003/242; B22F 2003/248
See application file for complete search history.

(56) References Cited

U.S. PATENT DOCUMENTS

| | | | | |
|---|---|---|---|---|
| 5,312,475 | A | 5/1994 | Purnell et al. | |
| 6,073,912 | A * | 6/2000 | Mori | F01L 3/02 123/188.3 |
| 6,082,317 | A | 7/2000 | Takahashi et al. | |
| 6,318,327 | B1 * | 11/2001 | Takahashi | F01L 3/02 123/188.3 |
| 2005/0132842 | A1 * | 6/2005 | Kawata | C22C 1/051 75/231 |
| 2009/0092848 | A1 * | 4/2009 | Yoshihiro | B22F 3/16 428/545 |
| 2009/0252639 | A1 | 10/2009 | Bergman et al. | |
| 2010/0101368 | A1 * | 4/2010 | Fang | C22C 29/08 75/240 |
| 2012/0288399 | A1 * | 11/2012 | Imaizumi | C22C 1/0433 420/440 |
| 2013/0156555 | A1 * | 6/2013 | Budinger | B23K 1/0018 415/182.1 |
| 2013/0259733 | A1 * | 10/2013 | Lee | F01L 3/02 419/10 |

FOREIGN PATENT DOCUMENTS

| | | | |
|---|---|---|---|
| AU | 007704281 A | * | 5/1982 |
| DE | 3935496 C1 | | 7/1990 |

(Continued)

OTHER PUBLICATIONS

English abstract for EP-0521821.

*Primary Examiner* — Jacob M Amick
*Assistant Examiner* — Charles Brauch
(74) *Attorney, Agent, or Firm* — Fishman Stewart PLLC

(57) ABSTRACT

A tribological system may include a valve seat ring composed of a sintered material and a valve having a surface at least in a seat region that may be at least one of (i) untreated, (ii) hardened, and (iii) plated. The sintered material may be a pressed and sintered powder mixture having a composition that may include (i) 5 to 45 wt % of at least one Fe-based hard phase, (ii) 0 to 2 wt % of each of graphite particles, MnS powder, $MoS_2$ powder, and FeP powder, (iii) 0 to 7 wt % copper powder and 0 to 4 wt % Co powder, (iv) 0.1 to 1.0 wt % of a pressing aid, (v) a high-speed steel having a composition including 14-18 wt % Cr, 1.2-1.9 wt % C, 0.1-0.9 wt % Si, 0.5-2.5 wt % of each of V, W, and Mo, and (vi) a balance of Fe and production-related impurities in quantities of <1.5 wt %.

20 Claims, 1 Drawing Sheet

(56) References Cited

FOREIGN PATENT DOCUMENTS

| | | | | | |
|---|---|---|---|---|---|
| EP | 0521821 | A2 | | 1/1993 | |
| EP | 1108800 | A2 | | 6/2001 | |
| EP | 0946774 | B1 | | 4/2004 | |
| EP | 2570507 | A1 | * | 3/2013 | ..... C22C 33/0285 |
| GB | 0615929 | | * | 8/2006 | |
| KR | 840006018 | A | * | 11/1984 | ..... C22C 33/0207 |
| WO | 2009024809 | A1 | | 2/2009 | |
| WO | 2009040369 | A1 | | 4/2009 | |

* cited by examiner

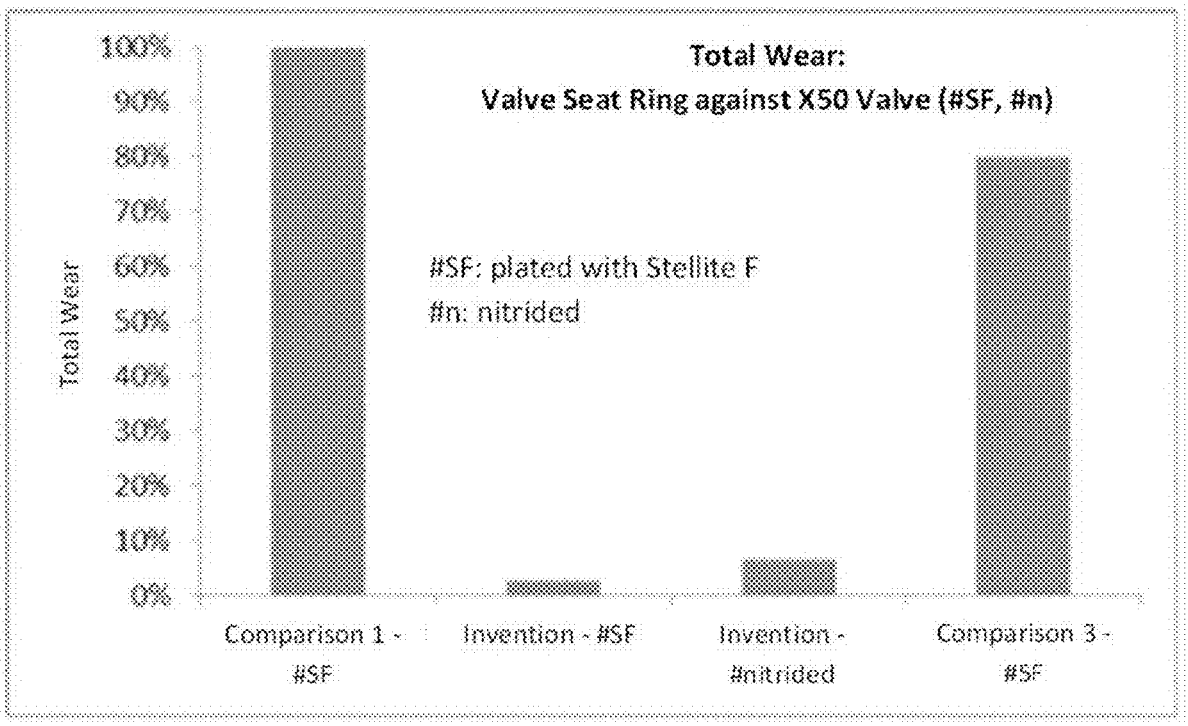
Total Wear:
Valve Seat Ring against X50 Valve (#SF, #n)
#SF: plated with Stellite F
#n: nitrided
Total Wear
100%
90%
80%
70%
60%
50%
40%
30%
20%
10%
0%
Comparison 1 - #SF
Invention - #SF
Invention - #nitrided
Comparison 3 - #SF

TRIBOLOGICAL SYSTEM, COMPRISING A VALVE SEAT RING AND A VALVE

CROSS-REFERENCE TO RELATED APPLICATIONS

This application claims priority to International Patent Application No. PCT/EP2016/065368, filed on Jun. 30, 2016, and German Patent Application No. DE 10 2015 213 706.6, filed on Jul. 21, 2015, the contents of both of which are hereby incorporated by reference in their entirety.

TECHNICAL FIELD

The invention relates to a tribological system comprising a valve seat ring made of sintered material and a valve that is untreated or hardened and or plated at least in the seat region.

BACKGROUND

During the new development of engines, but also when they are downsized, besides increasing the power concentration, the availability, and prolonging service life particular attention is also paid to constantly increasing the efficiency of the engines while reducing emissions. In order to satisfy these aspects, the individual engine components are often subject to greater demands than before with regard to durability and wear resistance.

An example of this are the inlet and outlet valve elements in the region of the engine combustion chamber, i.e. the valve and the associated valve seat ring, which together form a tribological system. They seal the combustion chamber and control the exchange of gases in the engine. The surfaces in this system that interact with and influence each other are exposed to extremely complex stresses caused by a cumulative load that prevails in a combustion engine consisting of mechanical, thermal, tribological and chemical stress.

At the same time, each partner in the tribological system described above must also fulfill some conditions that apply only to itself.

Thus, the valve seat ring must have high strength, in particular high resistance to deformation at moderately high temperatures (creep resistance), and high hot hardness, particularly since the outlet valves strike the valve seat more than 70 times per second. To ensure fast heat dissipation in the cylinder head and guarantee that the valve temperature is lowered, valve seat rings must also have good thermal conductivity. Last but not least, good lubricity and wear resistance are also imperative requirements for valve seat rings.

Valve seat rings with the above properties are usually created by sintering a material that is designed for sintering. The powder composition (Table 2) typically consists of a combination of a high-speed steel powder (such as the commercially widespread K3 or K1 powders) and one or more hard phases with Fe-base, optionally also Co-base, and other constituents such as solid lubricants, for instance sulfides, e.g., $MoS_2$ or K13, and/or graphite and/or copper and/or $CaF_2$. Such valve seat rings are often infiltrated with copper as well, to achieve a higher thermal conductivity and make them more easily workable. A disadvantage of these valve seat ring materials is that they are often quite aggressive towards the counterpart element and so cause increased wear on the valve.

The valves, and in particular the valve discs, must have good heat resistance since they are exposed to temperatures of up to 1,000° C., and good wear resistance. For this purpose, it is common to plate, harden and/or nitride the valves, particularly the valve discs, to improve the tribological properties of the system. There are also tribological systems in which the valve discs have not undergone any surface treatment.

Document U.S. Pat. No. 6,318,327B1 describes a tribological system consisting of a valve seat ring and a valve. The valve seat ring is made from an iron-based sintered material and fine inclusions of 10 to 50 wt % of a CoMoCr-based intermetallic hard phase, T 800 and T 400 for example. Solid lubricants (sulfides, nitrides, fluorides, graphite) are added; infiltration and impregnation with Cu is also described. Sintering takes place in a vacuum. This is very disadvantageous for a continuous sintering process of large quantities.

An austenitic steel (SUH35 (JIS G 431 1: 21% Cr-4% Ni-9% Mn 0.4% N-0.5% C—Fe (the rest)), which is nitrided or plated with stellite F, 6 or 12 or with K8, K10, to enhance wear resistance and thereby improve the tribological properties of the system.

The problem is that optimal properties are not reached for specific tribological systems, particularly since other valve materials are not considered. This is also significant because not only is the reliability of the system determined by the interaction between the valve disc and valve seat ring, but the valve guide must also be included in this consideration. To this extent, the limitation to just one group of valve materials results in a restriction for optimizing the material pairing.

WO 2009 024 809 A1 discloses a material for a valve seat ring in which an iron-based alloy with reduced levels of the carbides of Mo, W, V and Nb is used. This powder constitutes the largest part of the powder mixture for processing. In addition, it still includes the conventional additives for improved processing, sintering, and solid lubricants and hard phases and copper.

Besides the individual characteristics of each valve and valve seat ring, it is important for a tribological system to preserve the mechanical, physical and/or chemical interactions of the partners as minimal as possible. This is usually ensured by external lubrication via fuels, combustion products or the engine oil. If this external lubrication is reduced significantly or omitted entirely, the tribological system, which was previously exposed to a liquid or mixed friction, is increasingly exposed to a solid friction, which results in greater overall wear.

SUMMARY

The object of the invention is to provide a tribological system comprising a valve seat ring and an untreated or a hardened and/or plated valve which avoids the disadvantages of the prior art, and in particular exhibits greater wear resistance and reduced overall wear.

We solved this object with the tribological systems described in the patent claims.

According to a first aspect, the tribological system according to the invention comprises a first tribological partner, that is to say a valve seat ring made from a sintered material, which is characterized in that the sintered material is obtainable by pressing and sintering a mixture of individual powder components comprising 5 to 45 wt % of one or more Fe-based hard phases and 0 to 2 wt % graphite particles and/or 0 to 2 wt % MnS powder and/or 0 to 2 wt % $MoS_2$ powder and/or up to 2 wt % FeP powder and/or 0 to 7 wt % Cu powder and/or 0 to 4% by weight Co powder and 0 to 1.0 wt % of a pressing additive, and the balance being high-speed steel powder having a composition of 14-18 wt % Cr, 1.2-1.9 wt % C, 0.1 to 0.9 wt % Si, 0.5 to 2.5 wt % V, 0.5 to 2.5 wt % W, 0.5 to 2.5 wt % Mo, and the balance being Fe and production-related impurities, particularly of Ni, Cu, Co, Ca and/or Mn having fractions of <1.5 wt.

And a second tribological partner, specifically a valve of which the surface is untreated.

Alternatively, the second tribological partner is a valve that has been hardened and/or plated and/or nitrided at least in the seat region. Besides reduced wear in the tribological system, plating and/or nitriding the seat also helps to achieve improved sealing action of the valve during operation. The valves are therefore preferably nitrided and/or plated in the seat area with a Fe-based or Co-based material.

According to a second aspect, the tribological system according to the invention comprises a first tribological partner, that is to say a valve seat ring made from a sintered material, which is characterized in that the sintered material is obtainable by consolidating and sintering a mixture of individual powder components comprising 5 to 45 wt % of one or more Fe-based hard phases with a composition from 0 to 0.2 wt % C, 26 to 32 wt % Mo, 8 to 12 wt % Cr, 2.2 to 3 wt % Si and 0 to 2 wt % graphite particles and/or 0 to 2 wt % MnS powder and/or 0 to 2 wt % FeP powder and/or 0 to 2 wt % $MoS_2$ powder and/or 0 to 7 wt % Cu powder and/or 0 to 4 wt % Co powder, and 0.1-1.0 wt % of a pressing additive, and the balance being a powder similar to high-speed steel powder having a composition of 14-18 wt % Cr, 1.2-1.9 wt % C, 0.1 to 0.9 wt % Si, 0.5 to 2.5 wt % V, 0.5 to 2.5 wt % W, 0.5 to 2.5 wt % Mo, and the balance being Fe and production-related impurities, particularly of Ni, Cu, Co, Ca and/or Mn having fractions of <1.5 wt.

And a second tribological partner, specifically a valve of which the surface is untreated.

Alternatively, the second tribological partner is a valve that has been hardened and/or plated and/or nitrided at least in the seat region. Besides reduced wear in the tribological system, plating and/or nitriding the seat also helps to achieve improved sealing action of the valve during operation. The valves are therefore preferably nitrided and/or plated in the seat area with a Fe-based or Co-based material.

Compared with the known solution attempts, namely involving optimization of the properties of the individual partners of a tribological system, the invention is based on the surprising discovery that with the described composition of materials in the valve seat ring, obtained by mixing the selected starting powders and skilful selection of the valve, tribological partners may be achieved in which the solid friction in the valve seat ring-valve system may be minimized, so that overall wear may also be reduced significantly.

Strictly speaking, besides the valve seat ring and the valve with disc and stem, the tribological system also extends to the valve guide. Particularly if the valve seat and valve stem untreated, that is to say no hardened, coated or plated, adapting the valve guide cannot be disregarded. A suitable material pairing of valve stem and valve guide is also required here as well.

It has been found that even compared with sintered materials that have been alloyed with a high proportion of Co (see Comparison Example 2 below), reduced wear is observed in the tribological system of the invention. Compared with standard commercial sintered materials as well (see Comparison Example 1 below, see Comparison Example 3 below), a significant reduction in wear is observed. But the tribological system according to the invention, which is characterized by a significantly reduced wear of the individual tribological partners can only be arrived at by the skilful combination of the sintered material with untreated valves, or with valves that have been nitrided and/or are plated with a Fe-based or Co-based material in the seat region.

It was further found that the wear resistance of the tribological system according to the invention depends inter alia on the hardness and thickness of a nitriding diffusion layer formed at least in the seat region of the valve. The best results are obtained with a hardness >510 HV and a thickness >19 μm. It was also found that the wear resistance of the tribological system according to the invention depends inter alia on the coating type and coating thickness of a plating layer formed at least in the seat region of the valve. The best results are obtained with a layer thickness of the plating >400 μm and a Co content and/or Fe content of >40%.

Furthermore, studies have shown that materials according to the invention for the valve seat ring in combination with the standard mixture Nireva 3015 (having a composition in wt %: up to 0.08 C, up to 0.5 Si, up to 0.5 Mn, up to 0.015 P, to 0.01 S, 13.5 to 15.5 Cr, 30.0 to 33.5 Ni, 0.4 to 1.0 Mo, 1.6-2.2 Al, 2.3 to 2.9 Ti, 0.4 to 0.9 Nb, the balance being Fe) or with the standard mixture Nimonic 80 (having a composition in wt %: 0.04 to 0.1 C, up to 1.0 Si, up to 1.0 Mn, up to 0.02 P, up to 0.015 S, 18.0 to 21.0 Cr, >65.0 Ni, up to 3.0 Fe, up to 2.0 Co, 1.0 to 1.8 Al and 1.8 to 2.7 Ti) after optimum heat treatment also exhibit reduced total wear without surface treatment such as nitriding or plating.

Fe-based hard phases are less expensive than nickel and cobalt-based alloys and can be adjusted in targeted manner to specific applications by heat treatment. In this context, carbon hardens the matrix and also forms hard carbides which increase wear resistance. A further reduction of wear may be achieved if the Fe-based hard phase contains 26 to 32 wt % Mo, 8 to 12 wt % Cr and 2.2 to 3 wt % Si, preferably 26 to 32 wt % Mo, 14 to 20 wt % Cr and 2.9 to 4.2 wt % Si.

To address the differing engine-specific requirements in terms of wear resistance in various applications in practice, it may also be advantageous to add another, Co-based hard phase to the sintered material in addition to a Fe-based hard phase. In a preferred embodiment of the tribological system according to the invention, therefore, a Co-based hard phase is also added to the sintered material, preferably in a proportion of 0.5 to 9.9 wt %.

Preferred Fe-based hard phases (Table 2) are K11, K6, K7 and K4. Particularly preferred are K6 and K7. Preferred Co-based hard phases, which are suitable for used in the described tribological system, are K8, K9 and K10, wherein K8 and K9 are particularly preferred. The composition of the hard phases will be explained below.

By selecting suitable sintering parameters such as temperature, atmosphere or dewpoint, a microstructure can be adjusted in the valve seat ring in which the special carbides are formed significantly more coarsely in the sintered material than in conventional high-speed steels, for example. Despite the coarser carbides, the strength values measured in the compression test between 25 and 300° C. and described by the compressive yield Rd 0.2 of the sintered material, are comparable. However, the hot hardness is higher than that of the comparison materials.

BRIEF DESCRIPTION OF THE DRAWINGS

The FIGURE illustrates results for total wear after engine testing under full load and a test duration of 100 hours, comparing the tribological system according to the present disclosure with comparison materials of Comparison 1 and Comparison 3.

DETAILED DESCRIPTION

In the following, the invention will be described in greater detail with reference to embodiments.

Embodiment 1

Table 1 lists the compositions of a powder mixture according to the invention, "Invention", and a comparison mixture, "Comparison 3". Production engineering and technical additives (e.g. sulfides) are included in "Other". Some examples of mixture components that were used or usable within the scope of the invention are summarized in Table 2 (Starting powder).

TABLE 1

Powder mixtures without solid lubricant, process-related additives and Cu infiltrant.

| | | K1 | K2 | Graphite | K12 | Cu | K6 | Wax | Other |
|---|---|---|---|---|---|---|---|---|---|
| Comparison 3 | wt % | 84 | | 0.3 | 0.3 | 5 | 10 | 0.6 | 0.4 |
| Invention | wt % | | 84 | 0.3 | 0.3 | 5 | 10 | 0.6 | 0.4 |

TABLE 2

Starting powders (in wt %) that are usable for mixtures according to the invention. The compositions listed are to be understood as average values from different shipments which may vary by approximately 10% to 30% in respect of final value and absolute content.

| Name | C | P | Mn | Si | Cr | Ni | Mo | Cu | V | W | Co | Fe | Rest |
|---|---|---|---|---|---|---|---|---|---|---|---|---|---|
| K1 | 1.0 | | 0.4 | 0.4 | 4.0 | | 5.0 | | 3.0 | 6.0 | 1.0 | 78.9 | |
| K2 | 1.5 | | | 0.5 | 16.0 | | 1.5 | | 1.0 | 1.5 | | 60.3 | |
| K3 | 0.8 | 0.04 | 0.3 | 0.45 | 4.0 | 0.4 | 5.0 | 0.4 | 2.0 | 6.2 | 1.0 | Rest | 3 |
| K4 | | | | | | | 70 | | | | | 30 | |
| K5 | | | | | | 4 | 0.5 | 1.5 | | | | Rest | |
| K6 | 0.1 | | | 2.6 | 8.5 | | 28.5 | | | | | 50.8 | |
| K7 | 0.3 | | | 3.4 | 17.5 | | 28.0 | | | | | 60.3 | |
| K8 | 0.1 | | | 2.6 | 8.5 | | 28.5 | | | | 60.3 | | |
| K9 | 0.2 | | | 1.3 | 17.0 | | 22.0 | | | | 59.5 | | |
| K10 | | | | 3.4 | 17.5 | | 28.0 | | | | 51.1 | | |
| K11 | 0.1 | | 0.1 | 2.4 | 9.2 | 8.8 | 20.1 | | | | | 59 | |
| K12 | | 15 | | | | | | | | | | 85 | |
| K13 | | | 63 | | | | | | | | | | 37 |
| K14 | | | | | | | | 100 | | | | | |
| Pressing aids | 90.0 | | | | | | | | | | | | 10 |

In a first step, the powders listed in Table 1 and specified in greater detail in Table 2 are mixed in a tumble mixer for 30 minutes. Then, these mixtures are compressed at a pressure of 700 MPa to make valve seat rings (φa: 30 mm, φi: 23 mm; height: 6 mm). A subset of the rings is sintered at a temperature from 1,110 to 1,125° C. (about 30 min) in $N_2$—$H_2$ (17 to 25 vol % $H_2$) in a continuous furnace. Another subset is subjected to sintering at 1,132 to 1,145° C. (approximately 30 minutes) in $N_2$—$H_2$ (17 to 25 vol % $H_2$).

The sintering conditions employed and the sintering densities achieved are summarized in Table 3 (Sintered densities).

TABLE 3

Sintering conditions for the powder mixture "Invention" according to the invention and the mixture for comparison "Comparison 3".

| | Sintering conditions and sintered density | | | |
|---|---|---|---|---|
| | Tmax1 ° C. | Duration min | Tmax2 ° C. | Duration min |
| Comparison 3 | 1110-1125 | 20-33 | 1132-1145 | 20-33 |
| Invention | 1110-1125 | 20-33 | 1132-1145 | 20-33 |

Atmosphere: N2—H2 (17-25 vol % H2)

TABLE 4

Heat treatment for the powder mixture "Invention" according to the invention and the mixture for comparison "Comparison 3".

| Mixture | Variants of heat treatment after sintering | | | | | | | | |
|---|---|---|---|---|---|---|---|---|---|
| | Tempering | | | Quenching and tempering | | | | | |
| for comparison | T ° C. | Duration h | Cooling K/min | T h | Duration | Cooling | Tempering ° C. | Duration min | Cooling K/min |
| Comparison 3 | 620 | 2 | 5-10 | 880 | 2 | Oil | 580 | 40 | 5-10 |
| Invention | 620 | 2 | 5-10 | 880 | 2 | Oil | 580 | 40 | 5-10 |

The average diameters shown in Table 1 are obtained for the special carbides formed (MoC, VC, $Cr_2C_3$) because of the differing sintering conditions and the tempering (see Table 4).

The maximum temperature during sintering was 1,132 to 1,145° C. The hold time at the temperature indicated above was 20 to 33 minutes. A mixture of $N_2$—$H_2$ with an $H_2$ content of 17-25% was used for the sintering atmosphere.

After sintering, the sintered material underwent heat treatment as summarized in Table 4 (Heat treatment). For this purpose, both simple tempering at temperatures between 550 and 620° C. and a quenching and tempering process, i.e. hardening at 850 to 950° C.—oil quenching—tempering at 510 to 610° C. were used. Since the differences in the properties, particularly in wear resistance, workability and creep properties are small, the tempered material is used.

A measurement of the special carbides found an average diameter of 2.1 μm in conventional comparative materials and 4.0 μm in the sintered material according to the invention. The minimum and maximum values are given in addition to the average values in Table 5.

TABLE 5

Average diameter of the special carbides in the sintered powder mixture "Invention" according to the invention and in the mixture for comparison "Comparison 3".

| | Average diameter [um] | | |
|---|---|---|---|
| | Min | AVG | Max |
| Comparison 3 | 0.5 | 2.1 | 5.1 |
| Invention | 1.1 | 4.0 | 12.1 |

In Table 6, both the hardness and the 0.2% compression yield strength are shown at room temperature and at 300° C. Surprisingly, the strength values of the sintered material according to the invention are similar to those of conventional material for comparison despite the coarser carbides (see Comparison 3, for example).

TABLE 6

Strength characteristics and hardnesses after sintering/heat treatment of the powder mixture "Invention" according to the invention and the powder mixture "Comparison 3" for comparison.

| | Rd0.2 [Mpa] | | Hardness [HV10] | |
|---|---|---|---|---|
| T [° C.] | Invention | Comparison 3 | Invention | Comparison 3 |
| 25 | 1,400 | 1,813 | 415 | 391 |
| 300 | 1,328 | 1,195 | 372 | 349 |

The performance is evaluated in a tribological system with regard to overall wear on the valve seat ring and the valve seat of a valve plated with Stellite F. Test results for the sintered/heat-treated valve seat ring-valve combinations of the powder mixture "Invention" according to the invention were compared against the comparison mixture "Comparison 3" for comparison, and for two further mixtures which reflect the prior art.

The test results indicate total wear—after engine testing in the "Valve seat ring-Valve seat" tribological system, wherein valve seat rings made from the comparison materials "Comparison 1", "Comparison 2" and "Comparison 3" were considered as well as the valve seat ring prepared according to the invention ("Invention").

The test results illustrate the improved performance of the tribological system "Invention" according to the invention. With a skilful combination of the production and composition of the sintered material according to the invention and by combining a valve that has been plated at least in the seat region with Stellite F, the solid friction between tribological partners is reduced, thereby greatly lowering wear. The measured total wear is reduced in this case.

The valve seat ring in the "Comparison 1" tribological system consists of, in wt %: C: 1.5; S: 0.6; Cr: 3; Mo: 5 to 15; Cu: 10 to 20; V: 2; Fe: Balance; Other: 4.

"Comparison 2" is a Co-containing material which in addition to this expensive commodity also contains high levels of the refractory metals Mo and W. In detail, the functional region consists of the elements in wt %: C: 0.5 to 2; Mn: 1; Cr: 3 to 6; Mo: 8 to 15; Co: 16 to 22; W: 2 to 5; V: 1 to 3; Cu: 12 to 22; Fe: Balance; Other: 3.

In the tribological systems "Comparison 3", the valve seat ring has the following composition in wt %: C: 0.5 to 1.5; Si: 0.2 to 10; Cr: 2.5-5; Mo: 5 to 8; W: 3-6; V: 1 to 4; Cu: 10 to 20; Fe: Balance; Other: 3 and in "Invention" the VSR has the composition: C: 1 to 1.8; Si: 0.2 to 1.8; Mn: 0.6; Cr: 10 to 15; Mo: 2.5 to 4.5; V: 0.4 to 10; Cu: 0.8 to 1: 5; Fe: Balance; Other: 3.

These are the material systems described above according to Tables 2 (Powder mixture and starting powder). The tribological systems "Comparison 1" to "Comparison 3" are based on conventional valve seat ring materials, wherein "Comparison 1" was defined arbitrarily as having total wear of 100%.

Unlike "Comparison 1" to "Comparison 3" the valve seat ring "Invention" contains significantly smaller amounts of expensive elements and achieves significantly lower overall wear.

Embodiment 2

If the materials described in Embodiment 1 (Comparison 1, Comparison 3 and Invention) are compared in a test in which plated (F Stellite) and nitrided X50 valves are used as tribopartners, it is revealed after 100 hours of engine testing that the total wear (FIGURE) with a nitrided outlet valve is only slightly greater than that of a valve plated with inventive material. This tribological pairing is considerably superior to the standard commercial comparison materials Comparison 1 and Comparison 3. The FIGURE reproduces results for total wear after engine testing under full load and a test duration of 100 hours.

Embodiment 3

In an motor test (500 h, hot and cold endurance) with uncoated or untreated Nimonic 80-outlet valves, the valve seat materials described in Embodiment 1 (Comparison 3 and Invention) exhibit very low total wear. The wear on the valve seat ring and the valve disc is so low that it is not measurable. On the material according to the invention (Invention), original machining marks are still visible. Since the material according to the invention is especially economical due to its use of small amounts of special carbides, a significant financial advantage over comparison material "Comparison 3" is obtained with comparable technical performance (overall wear not measurable).

The invention claimed is:

1. A tribological system, comprising:

a valve seat ring composed of a sintered material;

a valve having a surface at least in a seat region that is at least one of (i) untreated, (ii) hardened, and (iii) plated;

wherein the sintered material is a pressed and sintered powder mixture having a composition including:

5 to 45 wt % of at least one Fe-based hard phase;

0 to 2 wt % graphite particles, 0 to 2 wt % MnS powder, 0 to 2 wt % $MoS_2$ powder, and 0 to 2 wt % FeP powder;

0 to 7 wt % copper powder and 0 to 4 wt % Co powder;

0.1 to 1.0 wt % of a pressing aid;

a balance of a high-speed steel having a composition including 14-18 wt % Cr, 1.2-1.9 wt % C, 0.1 to 0.9 wt % Si, 0.5 to 2.5 wt % V, 0.5 to 2.5 wt % W, and 0.5 to 2.5 wt % Mo, and a remainder of Fe and production-related impurities in quantities of <1.5 wt %; and wherein the at least one Fe-based hard phase has a composition including <0.2 wt % C, 26 to 32 wt % Mo, 8 to 12 wt % Cr, and 2.2 to 3 wt % Si.

2. The tribological system according to claim 1, wherein the remainder of Fe includes 0 to 40 wt % of a base powder of pure Fe and 0 to 40 wt % of a Fe-based powder.

3. The tribological system according to claim 1, wherein the composition of the pressed and sintered powder mixture further includes a Co-based hard phase in a proportion of 0.5 to 9.9 wt %.

4. The tribological system according to claim 1, wherein the valve is untreated in the seat region and is composed of at least one of Nimonic 80, Nireva 3015, and a nickel-based alloy.

5. The tribological system according to claim 4, further comprising a valve guide composed of a material complementary to the valve.

6. The tribological system according to claim 1, wherein the valve, at least in the seat region, is at least one of nitrided and plated with a material based on one of Fe and Co.

7. The tribological system according to claim 1, wherein the valve, at least in the seat region, includes a nitriding layer having a hardness >510 HV and a thickness >10 μm.

8. The tribological system according to claim 1, wherein the valve, at least in the seat region, includes a plating layer having a layer thickness >200 μm and at least one of a Co content and a Fe content >40%.

9. The tribological system according to claim 1, wherein the sintered material is infiltrated with a Cu-based infiltrant when it is sintered.

10. The tribological system according to claim 1, wherein the sintered material is heat treated after it is sintered.

11. The tribological system according to claim 1, wherein the production-related impurities include at least one of Ni, Cu, Co, Ca, and Mn.

12. The tribological system according to claim 1, wherein the at least one Fe-based hard phase includes a second Fe-based hard phase having a composition including <0.3 wt % C, 26 to 32 wt % Mo, 14 to 20 wt % Cr, and 2.9 to 4.2 wt % Si.

13. The tribological system according to claim 3, wherein the Co-based hard phase has a composition including 0.1 wt % C, 2.6 wt % Si, 8.5 wt % Cr, 28.5 wt % Mo, and 60.3 wt % Co.

14. The tribological system according to claim 3, wherein the Co-based hard phase has a composition including 0.2 wt % C, 1.3 wt % Si, 17 wt % Cr, 22 wt % Mo, and 59.5 wt % Co.

15. A tribological system, comprising:

a valve seat ring composed of a sintered material;

a valve having a surface at least in a seat region that is at least one of (i) untreated, (ii) hardened, and (iii) plated;

wherein the sintered material is a pressed and sintered powder mixture having a composition including:

5 to 45 wt % of at least one Fe-based hard phase;

0 to 2 wt % graphite particles, 0 to 2 wt % MnS powder, 0 to 2 wt % $MoS_2$ powder, and 0 to 2 wt % FeP powder;

0 to 7 wt % copper powder and 0 to 4 wt % Co powder;

0.1 to 1.0 wt % of a pressing aid;

a balance of a high-speed steel having a composition including 14-18 wt % Cr, 1.2-1.9 wt % C, 0.1 to 0.9 wt % Si, 0.5 to 2.5 wt % V, 0.5 to 2.5 wt % W, and 0.5 to 2.5 wt % Mo, and a remainder of Fe and production-related impurities in quantities of <1.5 wt %; and wherein the at least one Fe-based hard phase has a composition including <0.3 wt % C, 26 to 32 wt % Mo, 14 to 20 wt % Cr, and 2.9 to 4.2 wt % Si.

16. The tribological system according to claim 15, wherein the composition of the pressed and sintered powder mixture further includes a Co-based hard phase in a proportion of 0.5 to 9.9 wt %, and wherein the Co-based hard phase has a composition including one of:

0.1 wt % C, 2.6 wt % Si, 8.5 wt % Cr, 28.5 wt % Mo, and 60.3 wt % Co; and 0.2 wt % C, 1.3 wt % Si, 17 wt % Cr, 22 wt % Mo, and 59.5 wt % Co.

17. A tribological system, comprising:

a valve seat ring composed of a sintered material;

a valve having a surface at least in a seat region that is at least one of (i) untreated, (ii) hardened, and (iii) plated;

wherein the sintered material is a pressed and sintered powder mixture having a composition including:

5 to 45 wt % of at least one Fe-based hard phase;

0 to 2 wt % graphite particles, 0 to 2 wt % MnS powder, 0 to 2 wt % $MoS_2$ powder, and 0 to 2 wt % FeP powder;

0 to 7 wt % copper powder and 0 to 4 wt % Co powder;

0.1 to 1.0 wt % of a pressing aid;

a balance of a high-speed steel having a composition including 14-18 wt % Cr, 1.2-1.9 wt % C, 0.1 to 0.9 wt % Si, 0.5 to 2.5 wt % V, 0.5 to 2.5 wt % W, and 0.5 to 2.5 wt % Mo, and a remainder of Fe and production-related impurities in quantities of <1.5 wt %; and wherein the valve is untreated in the seat region and is composed of at least one of Nimonic 80, Nireva 3015, and a nickel-based alloy.

18. The tribological system according to claim 17, further comprising a valve guide composed of a material complementary to the valve.

19. The tribological system according to claim 17, wherein the at least one Fe-based hard phase has a composition including <0.2 wt % C, 26 to 32 wt % Mo, 8 to 12 wt % Cr, and 2.2 to 3 wt % Si.

20. The tribological system according to claim 17, wherein the at least one Fe-based hard phase has a composition including <0.3 wt % C, 26 to 32 wt % Mo, 14 to 20 wt % Cr, and 2.9 to 4.2 wt % Si.

* * * * *